US005996861A

United States Patent [19]

Propach

[11] Patent Number: 5,996,861

[45] Date of Patent: Dec. 7, 1999

[54] METHOD AND DEVICE FOR FOLDING HOSIERY ITEMS

[75] Inventor: Hans Walter Propach, Zell u. A., Germany

[73] Assignee: Wepamat Maschinenbau GmbH, Germany

[21] Appl. No.: 09/032,611

[22] Filed: Feb. 27, 1998

[51] Int. Cl.[6] ..... A41H 33/00

[52] U.S. Cl. ..... 223/37; 223/38

[58] Field of Search ..... 223/37, 38; 493/405, 493/415, 416, 413, 423

[56] References Cited

U.S. PATENT DOCUMENTS

| | | | |
|---|---|---|---|
| 1,957,651 | 5/1934 | Joa | 223/37 |
| 3,827,611 | 8/1974 | Grantham et al. | 223/37 |
| 4,106,260 | 8/1978 | King | 223/37 |
| 4,425,173 | 1/1984 | Frick | 223/38 |
| 4,694,978 | 9/1987 | Westphal et al. | 223/37 |
| 5,108,017 | 4/1992 | Adamski, Jr. | 223/38 |
| 5,540,647 | 7/1996 | Weierman et al. | 223/37 |
| 5,788,130 | 8/1998 | Todd et al. | 223/37 |

OTHER PUBLICATIONS

Leaflet "Wepamat BLM 751 Hosiery Folder", pp. 1–2.

*Primary Examiner*—Bibhu Mohanty
*Attorney, Agent, or Firm*—Ostrolenk, Faber, Gerb & Soffen, LLP

[57] ABSTRACT

A method for folding hosiery items is disclosed. The hosiery items are wrapped about a folding card and are folded, together with the folding card, against an inclined belt at an acute angle relative to a lower belt, with the trailing portion of the hosiery item resting on that lower belt. The hosiery item is then initially clamped against the lower belt in the vicinity of the folding card, preferably by means of a clamping slide, and is then tensioned about the folding card, preferably by means of a tensioning slide, before the hosiery item is transferred, by advancing the lower belt and the inclined belt, to the pivoting belt, after the latter has been returned to its original position, from where it is then transported between two subsequent, mutually parallel belts, one of which can be moved away from the other in parallel orientation, in order to prevent any rolls from forming during movement into the space between the two belts.

12 Claims, 3 Drawing Sheets

METHOD AND DEVICE FOR FOLDING HOSIERY ITEMS

BACKGROUND OF THE INVENTION

The present invention relates to a method for folding hosiery items where the hosiery items are wrapped about a folding card and are folded, together with the latter, against an inclined surface extending at an acute angle relative to a lower belt, with the remaining portion of the hosiery item resting on that lower belt, and are then transported to two subsequent belts.

The invention further relates to a device for folding hosiery items, comprising a lower belt and an inclined first surface arranged above it, at an acute angle, as well as a pivoting belt that can be pivoted in upward direction between a transport position, in which it is aligned with the lower belt, and an inclined position, as well as two subsequent belts.

A method and a device of this kind, suited in particular for folding and packaging ladies' pantyhose, have been marketed for many years under the designation "wepamat BLM 751" (compare the leaflet entitled "wepamat BLM 751 hosiery folder").

In the case of the known device, a pantyhose is delivered onto two belts arranged horizontally one behind the other, whereafter a folding card is picked from a magazine by a swinging sucker and deposited on the pantyhose. At the same time, the rear belt is tilted in downward direction, and the forward belt is advanced, by suitable driving means, whereby the pantyhose is folded for the first time. The pantyhose is then transported onto a second belt, located in front of the tilted rear belt, and from there onto a further belt located beneath it and being inclined in upward direction. Another belt arranged above the latter and in parallel thereto, which is then moved in rearward direction, causes the pantyhose to be folded at its forward end, whereafter the pantyhose is folded once more by advancing the belts. The pantyhose, having been folded about the folding card in this way, with its rear end pointing again in forward direction, now reaches a lower belt above which there is arranged an inclined belt, extending in upward direction at an acute angle. In front of the inclined belt, there is arranged a pivoting belt that can be moved between a transport position, in which it is aligned with the lower belt, and a pivoted position, in which it extends substantially in parallel to the inclined belt. Now, the forward portion of the pantyhose, folded about the folding card, is moved from the lower belt onto the pivoting belt located in front of it, while the rear portion of the pantyhose still rests on the lower belt, folded over in forward direction. The pivoting belt is now moved in upward direction in order to fold over the forward portion of the pantyhose with the folding card contained therein and to deposit it on the inclined belt. Once the pivoting belt has returned to its position aligned with the lower belt, the inclined belt and the lower belt are advanced to cause the pantyhose to be placed on the pivoting belt, whereby it is folded for the third time. Thereafter, the pivoting belt is driven to move the folded pantyhose into the space between two subsequent belts, arranged in parallel one to the other, from where it is then transported, for example, to a downstream packaging unit for being placed into a flat bag.

It has been found to be a disadvantage of the known device and the known method that they always tend to produce a roll at the rear end of the folding card as the transporting and folding operations cause any excessive material to gather at the rear upper end of the folding card.

Now, it is the object of the present invention to provide an improved method and an improved device for folding hosiery items whereby the risk of formation of such rolls is reduced.

In a method for folding hosiery items, where the hosiery items are wrapped about a folding card and are folded over against an inclined surface at an acute angle relative to a lower belt, with the remaining portion of the hosiery item resting on that belt, and are then transported to two subsequent belts, this object is achieved by the fact that the hosiery item is initially clamped against the lower belt, in the vicinity of the folding card, is then stretched on the folding card and thereafter transported to the subsequent belts, by means of the lower belt and preferably by means of the inclined surface which latter is preferably configured as an inclined belt. The object underlying the invention is thus perfectly achieved.

It has been realized that in the case of the prior-art device and the prior-art method folding the folding card, with the portion of the pantyhose wrapped about it in upward direction, by means of the pivoting belt has the result that the subsequent advancing motion of the inclined belt (inclined surface) and of the lower belt will always cause a roll to form at the rear end of the folding card.

The invention recognizes that this can be avoided if the hosiery item is initially clamped onto the lower belt in the vicinity of the folding card, and is then stretched on the folding card. When the inclined belt and the lower belt are then advanced, while the clamped condition and the tension of the folding card are simultaneously released, then the formation of a roll can be avoided, it being even possible to stretch the hosiery material to some extent in the area of the folding card so that any excessive material that may be transported to the rear will be compensated for by the tension of the folding card and come to lie flat on the folding card.

Further, in a device for folding hosiery items comprising a lower belt and a stationary inclined surface arranged above the lower belt, at an acute angle, and a pivoting belt that can be moved between a transport position, in which it is aligned with the lower belt and an inclined position in which it is pivoted in upward direction, and comprising further two subsequent belts, the object of the invention is achieved by the fact that there are provided a clamping device for clamping the hosiery item against the lower belt and a tensioning device for tensioning the hosiery item about the folding card.

The object of the invention is thus perfectly achieved, the formation of a roll of hosiery material at the rear end of the folding card during the folding process being avoided in the manner described above.

Alternatively, in the case of a method for folding hosiery items, where the hosiery item is wrapped about a folding card and is then transported into the space between two subsequent belts, the object of the invention is achieved by the fact that initially one of the two subsequent belts is moved away from the other, whereafter the hosiery item, positioned on one of the two belts, is moved into the enlarged space between the two belts, whereupon the two belts are moved together again.

This also counteracts the formation of rolls as the folded hosiery item can be moved without any difficulty, in a first step, into the space between the two subsequent belts, whereafter, in a second step, the other belt is approached again toward the hosiery item.

With respect to the device, the object of the invention is correspondingly achieved by the fact that one of the two subsequent belts is arranged for displacement relative to the other belt.

Certain advantageous developments of the invention are defined in the dependent claims. With respect to the method it is preferred that the hosiery item is initially guided over the lower belt, is then moved together with the folding card onto a preceding belt, viewed in the direction of movement, whereafter the pivoting belt is pivoted in upward direction so as to fold the folding card, with the hosiery item wrapped about it, in upward direction at the acute angle, whereafter the pivoting belt is returned to its initial position.

This provides a favorable way of folding the hosiery item about the folding card.

It is further preferred that during transport of the hosiery item onto the pivoting belt, after the latter has been returned to its initial position, the inclined belt is driven at a somewhat higher speed than the lower belt, and/or is switched on a little before the lower belt.

This ensures that the hosiery item assumes its correct position as it leaves the inclined belt and the lower belt.

For clamping the hosiery item against the lower belt, in the vicinity of the folding card, an advantageous further development of the invention provides for a clamping slide which can be moved against the lower belt in a space formed between the lower belt and the inclined belt and which is preferably bent off in downward direction at its forward end.

For tensioning the hosiery item about the folding card an advantageous further development of the invention provides for a tensioning slide which can be moved between the clamping slide and the inclined belt and by means of which the hosiery item can be tensioned in the area of the lower end of the folding card.

This feature enables any formation of rolls at the rear end of the folding card to be reliably avoided.

The bent-off forward edge of the clamping slide facilitates the movement of the clamping slide into the space between the two belts and over the rear portion of the folded hosiery item.

According to another advantageous embodiment of the invention it is preferred that once the folded hosiery item has been moved into the enlarged space between the two subsequent belts, the contact pressure can be adjusted during movement of the two belts one toward the other.

This feature permits the pressure to be optimally adjusted to the particular hosiery item being processed, and the slight pressure further produces a slight mechanical hook-on effect between the different plies, whereby the hosiery item will be prevented from slipping and coming apart during the subsequent packaging and, if applicable, turning steps.

It is understood that the features mentioned above and those yet to be explained below can be used not only in the respective combinations indicated, but also in other combinations or in isolation, without leaving the context of the present invention.

SHORT DESCRIPTION OF THE DRAWINGS

The invention will be described and explained in more detail below with reference to a selected exemplifying embodiment. In the drawings:

FIGS. 1*a*–1*d* show a diagrammatic representation of a prior-art device for folding hosiery items, illustrating four successive phases of the hosiery folding process; and FIGS. 2*a*–2*e* show a diagrammatic representation of a device for folding hosiery items, according to the invention, illustrating five successive phases of the hosiery folding process, FIGS. 3*a*–3*c* show a diagrammatic representation of a prior-art device for prefolding hosiery items for subsequent processing according to the invention by the device according to FIG. 2*a*–2*e*.

DETAILED DESCRIPTION OF THE PREFERRED EMBODIMENT

Figure 1A:
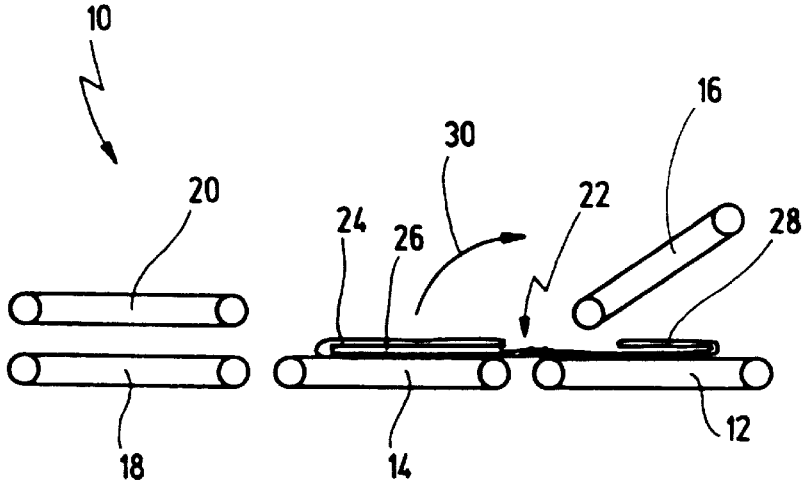

FIG. 1 shows a diagrammatic representation of a prior-art device for folding hosiery items, generally indicated by reference numeral 10.

The device 10 comprises a lower belt 12, onto which the hosiery item is transported, already folded twice, from a preceding belt in the device. An inclined belt 16 is arranged obliquely above the lower belt 12 and at an acute angle relative thereto. Before the lower belt 12, viewed in the transport direction, there is provided a pivoting belt 14 that can be moved to and fro, as indicated by arrow 30 in FIG. 1*a* and arrow 32 in FIG. 1*b*, between a transport position, illustrated in FIG. 1*a*, in which it is aligned with the lower belt 12, and an inclined position in which it extends substantially parallel to the inclined belt 16, at a sufficient distance therefrom. Before the pivoting belt 14, viewed in the transport direction, there is provided a subsequent belt 18, aligned with the belt described before, with a belt 20 extending above the belt 18 at a predetermined distance and in parallel thereto.

In the representation of FIG. 1*a* it is assumed that the hosiery item 22 has already been folded twice in previous stages of the folding device, not shown in the drawing, so that the hosiery item comes to lie on the horizontally extending pivoting belt 14 by a forward portion 24, folded about a folding card 26, whereas a rear portion 28, folded once in forward direction, rests on the lower belt 12.

Figure 1B:
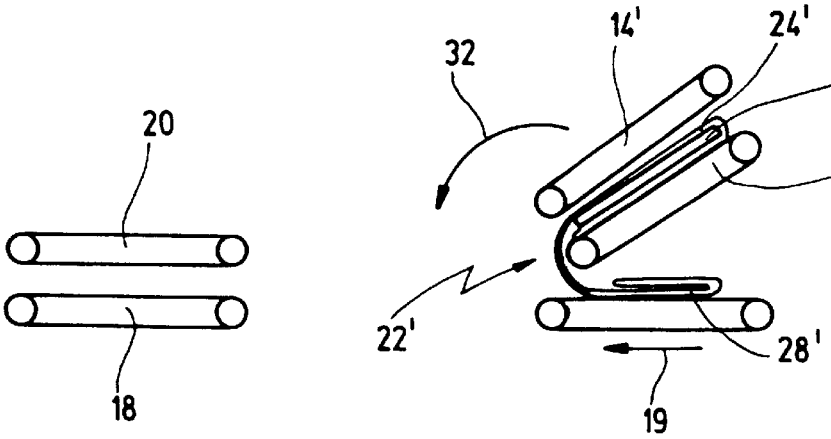

For carrying out the third folding operation, the pivoting belt 22 is now pivoted in upward direction, as indicated by arrow 30, until the forward portion 24, together with the folding card 26, is folded back and transferred to the inclined belt 16, as shown in FIG. 1*b*. As can be seen in FIG. 1*b*, the rear portion 28' of the hosiery item 22' still rests on the lower belt, while the portion 24', wrapped about the folding card 26', is positioned on the inclined belt 16. Now, the pivoting belt is pivoted back from its pivoted position illustrated in FIG. 1*b* and designated by 14' to is original position indicated by 14" in FIG. 1*c*. Thereafter, the inclined belt 16 and the lower belt 12 are advanced so that the upper end of the hosiery item, with the folding card contained therein, is transported off the inclined belt 16 and folded onto the rear or lower ply so that finally it assumes the position 22" shown in FIG. 1*c*.

As indicated by reference numeral 34, this causes a roll to form at the rear end of the hosiery item 22', above the folding card 26".

This roll 34 results from the fact that during transfer of the hosiery item from the pivoting belt to the inclined belt 16, the lower ply of the hosiery item hangs down from the folding card whereby excessive material gathers at the end of the folding card.

Figure 1C:
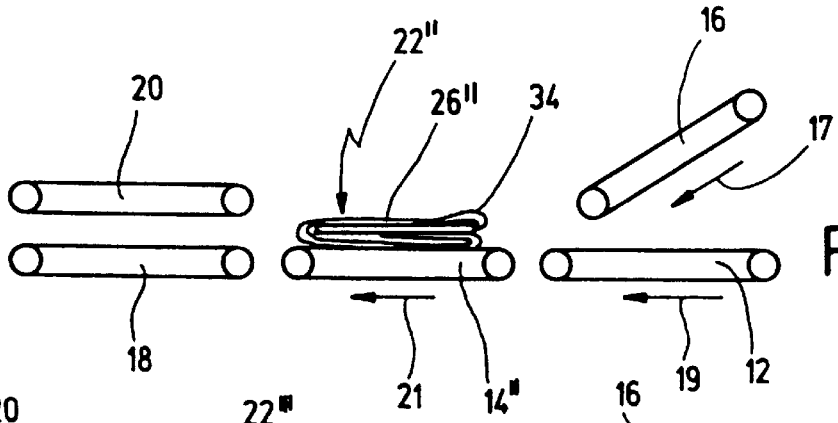
Figure 1D:
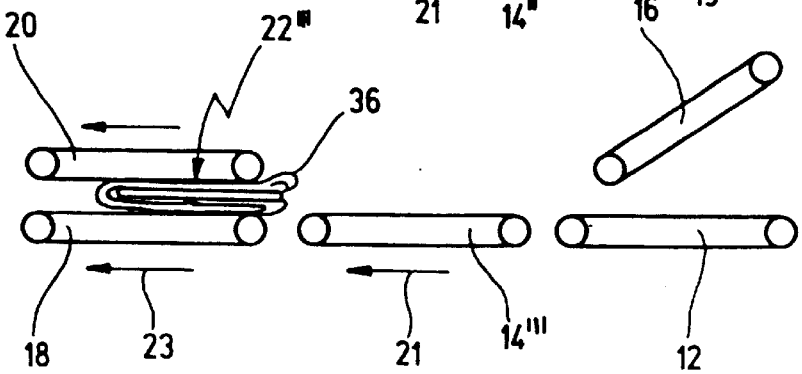

From the position shown in FIG. 1*c* the hosiery item is finally transported, by driving the pivoting belt 14"' and the subsequent belt 18 in the direction of arrows 21 and 23, into the space between the subsequent belt 18 and the parallel belt 20 arranged above it, into the position indicated in FIG. 1*d* by reference numeral 22"'. Given the fact that the front portion of the hosiery item is somewhat compressed as it enters the space between the two belts 18 and 20, a further portion of the hosiery item is displaced to the rear whereby the roll 36 at the rear end of the hosiery item 22"', having now been folded three times, is further enlarged. The roll so formed, which is regarded as a disadvantage by pantyhose manufacturers and which has a detrimental effect especially on the presentation of the finished packaged goods, is avoided by the present invention.

A device for folding hosiery items according to the invention is illustrated in FIGS. 2*a* to 2*e* and indicated generally by reference numeral 40.

Figure 2A:
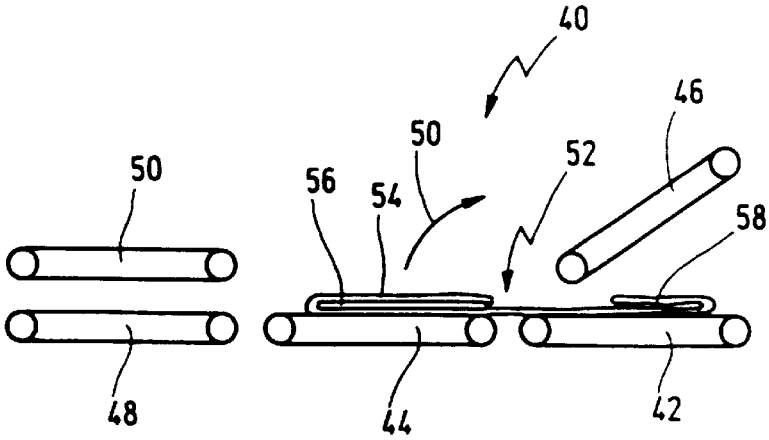
Figure 2B:
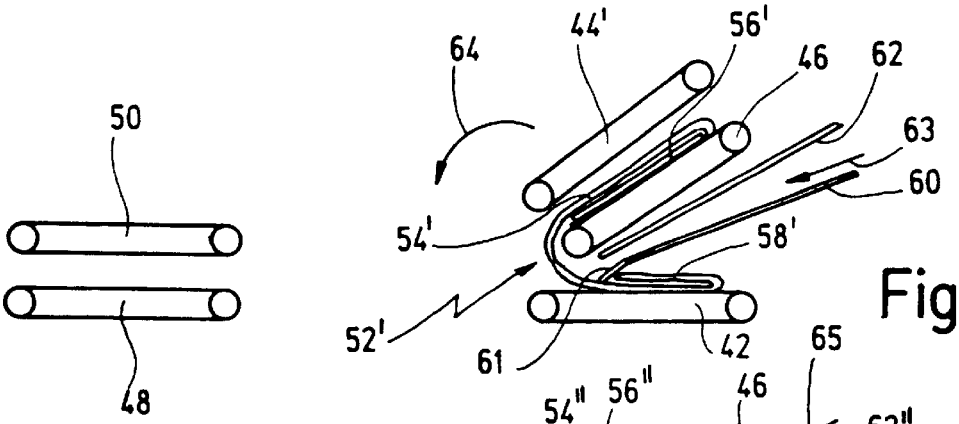
Figure 2C:
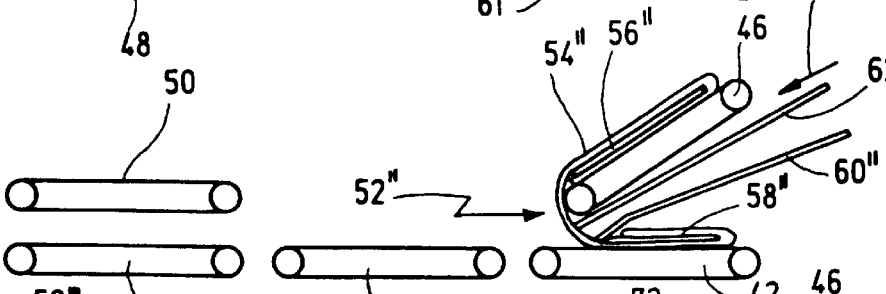

Again, the device 40 comprises a lower belt 42, an inclined belt 46 arranged above the latter at an acute angle of approximately 30 to 60°, a preceding pivoting belt 44, viewed in the transport direction, which can be pivoted between a transport position in which it is in alignment with the lower belt 42 and an inclined position as shown in FIG. 2*b,* and two mutually parallel subsequent belts 48, 50, the lower belt 48 being aligned relative to the pivoting belt 44, as shown in FIG. 2*a.* Alternatively, the inclined belt 46 may also be designed simply as an inclined surface.

The device 40 according to the invention differs from the prior-art device 10 by the fact that a clamping slide 60 and a tensioning slide 62 are provided, which are illustrated in FIGS. 2*b* to 2*e* and the operation of which will be described hereafter.

As will be seen in FIG. 2*a,* the forward end of the hosiery item 52 (in this case a ladies' pantyhose) has already been folded about a folding card in such a way that two plies (leg portion) of the hosiery item 52 are located above the folding card 56 and two plies (leg portion) of the hosiery item 52 are present below the folding card 56. The forward portion 54 of the hosiery item 52, being wrapped about the folding card 56, rests on the horizontally aligned pivoting belt 44. The rear portion 58 of the hosiery item 52 rests on the lower belt 42 and has been folded over once in forward direction.

Being not part of the object of the present invention, the preceding folding stations of the device 40 are not illustrated and described in more detail in this specification.

In order to effect a folding operation on the hosiery item 52, approximately in the area of transition between the lower belt 42 and the pivoting belt 44, the pivoting belt 44 is pivoted in upward direction, as indicated by arrow 50 in FIG. 2*a,* so that it comes to occupy the pivoted position 44' illustrated in FIG. 2*b,* in which it assumes a position substantially parallel to and above the inclined belt 46. The portion 54' wrapped about the folding card 56' is thus transported onto the inclined belt 46, together with the folding card 56', whereas the rear portion or remaining folded portion 58' of the hosiery item 52' remains on the lower belt 42.

A clamping slide, whose forward edge 61 is bent off to a certain degree or beveled in downward direction is now introduced into the space between the lower belt 42 and the inclined belt 46 and pressed against the hosiery item 52' by its forward edge 61 in order to urge the hosiery item down upon the lower belt 42 and to fix it thereon, before the remaining portion 58' is folded over (compare arrow 63). Thereafter, the pivoting belt is pivoted back to its original position, as indicated by arrow 64 in FIG. 2*c.* At the same time, or some time before, a tensioning slide positioned between the clamping slide 60 and the inclined belt 46, is moved further down, as indicated by arrow 65, and into the space between the clamping slide 60" and the inclined belt 46, so that the hosiery item 52" is tensioned or stretched on the front edge of the tensioning slide 62" and the folding card 56" may even be tensioned or bulged to a certain degree, depending of the length of the advancing movement. In any case, the further inward movement of the tensioning slide 62", with the rear portion 58" clamped in place, has the effect to stretch the portion 54" that is wrapped around the folding card.

Figure 2D:
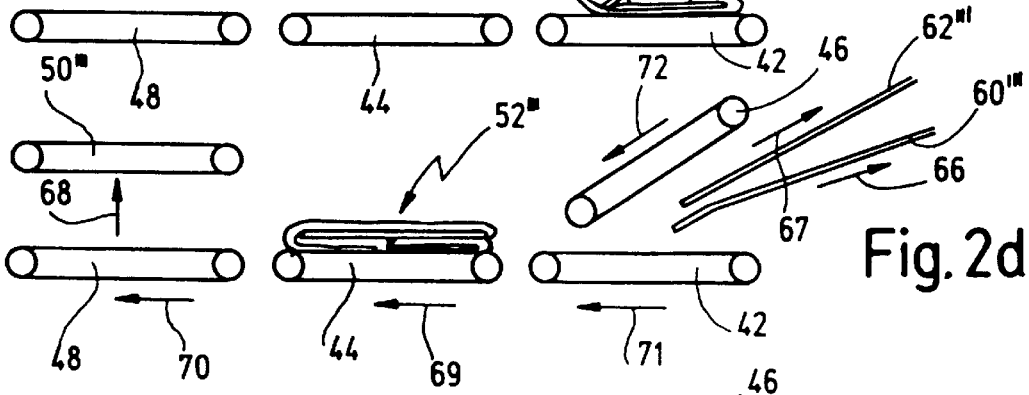

Thereafter, the two slides 60''' and 62''' are withdrawn in the directions indicated in FIG. 2*d* by arrows 66 and 67, respectively, whereby the hosiery item is released and transferred, by a respective movement of the inclined belt 46 and the lower belt 42, onto the preceding pivoting belt 44, as indicated by arrows 71 and 72. Thus, the third fold of the hosiery item is complete, and the hosiery item 52''' rests in folded condition, as illustrated in FIG. 2*d,* on the horizontally aligned pivoting belt 44.

Simultaneously with this operation, the upper subsequent belt 50''' (viewed in the direction of material flow) is moved away from the lower subsequent belt 48 in upward direction and in parallel thereto, as indicated by arrow 68, in order to enlarge the space between the two belts 48, 50'''. Alternatively, it would also be possible to tilt one of the two belts.

By moving the pivoting belt 44 in the direction indicated by arrow 69 and the subsequent belt 48 in the direction indicated by arrow 70, the hosiery item 52''' can now be transported onto the belt 48.

Figure 2E:
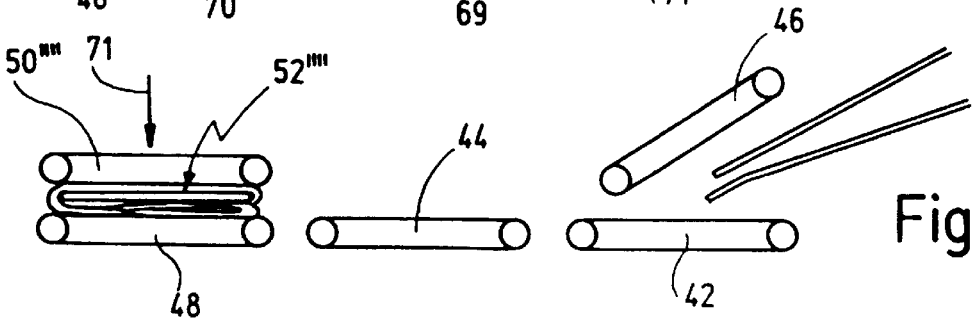

Finally, the upper belt 50'''' is returned to its lower position, as indicated by arrow 71 in FIG. 2*e,* so that the hosiery item 52'''' is pressed between the two belts 48, 50'''' at a predetermined pressing force.

This brings about a hook-on effect between the different plies of the hosiery item 52'''' which facilitates any subsequent handling of the hosiery item 52'''' during subsequent turning operations or during packaging as it practically prevents the different plies from getting displaced one relative to the other or coming apart during subsequent handling operations.

Figure 3A:
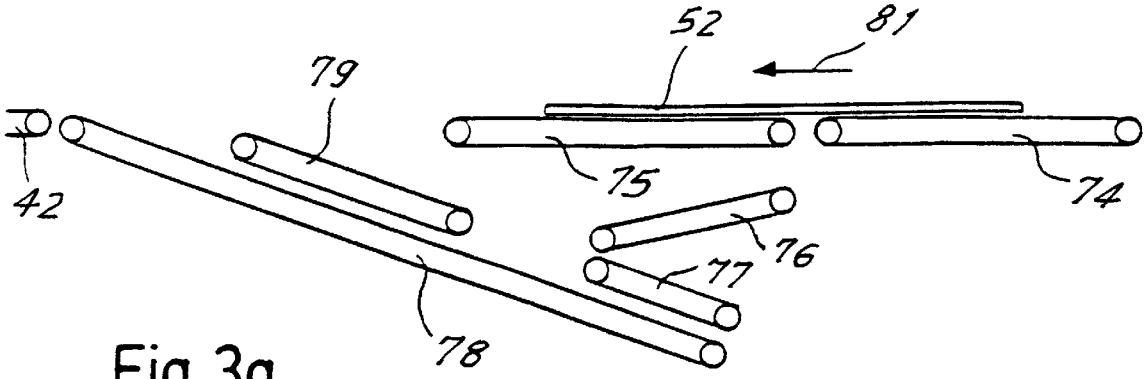
Figure 3B:
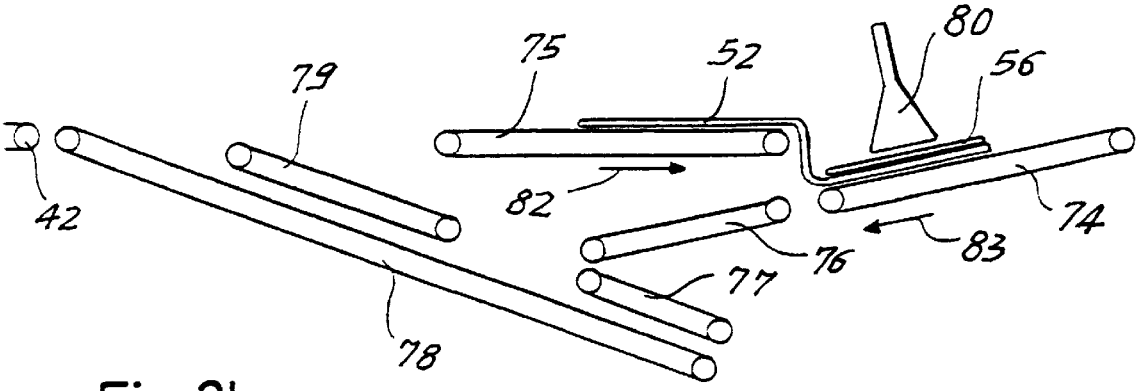

In FIGS. 3*a*–3*b* a device is described for prefolding the hosiery item about a folding card such that the condition as shown in FIG. 2*a* is reached.

Figure 3C:
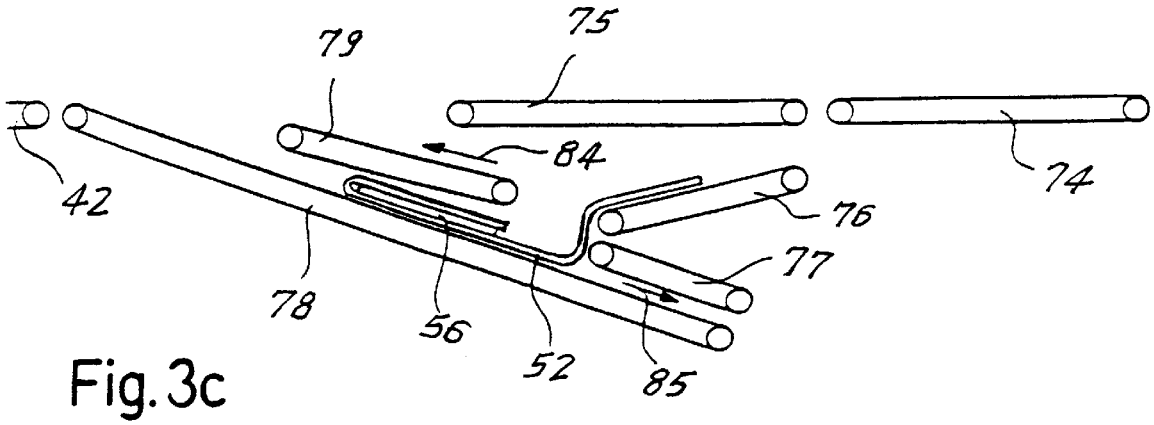

The device according to FIGS. 3*a*–3*c* is well-known in the art and is, consequently, only be described in brief. The hosiery item 52 may be put manually onto belt 74 when in a horizontal position or may be forwarded automatically onto belt 74 from a preceding belt. The hosiery item 52 is forwarded partly onto belt 75 arranged horizontally upstream before belt 74, to reach the position as shown in FIG. 3*a.* Thereafter, according to FIG. 3*b* belt 74 is tilted downwardly to become aligned with inclined belt 76 arranged upstream before belt 74. Belt 75 is now driven backwardly as shown by arrow 82, while belts 74 and 76 are driven forwardly as shown by arrow 83. A folding card 56 is put onto the hosiery item 52 by a suction means 80 as shown in FIG. 3*b.* The hosiery item 52 is folded at this position for the first time and is then advanced over belt 76 to a long slightly upwardly inclined belt 78.

According to FIG. 3*c,* thereafter, a belt 79 arranged almost in parallel above belt 78 is driven forwardly as shown by arrow 84, while a belt 77 arranged below inclined belt 76 and in parallel to the end of long belt 78 is driven backwardly as shown by arrow 85 in FIG. 3*c.* Thereby, the hosiery item is folded a second time and may then be advanced to the lower belt 42 according to FIG. 2*a.*

I claim:

1. A method for folding a hosiery item tightly about a folding card, said method comprising:

providing the hosiery item with a leading portion and a trailing portion;

folding said leading portion about said folding card backwardly against a direction of movement such that said folding card is enclosed between a lower layer and an upper layer of said leading portion;

supporting said leading portion with said folding card on a pivoting belt in a downward position thereof;

supporting said trailing portion on a lower belt behind said pivoting belt;

pivoting said pivoting belt upwardly and backwardly against the direction of movement, thereby folding the leading portion of the hosiery item together with the folding card against an inclined surface arranged at an acute angle relative to said lower belt;

clamping the hosiery item in the vicinity of said folding card between said leading and said trailing portions against said lower belt;

stretching the hosiery item on said folding card;

moving said pivoting belt back into its downward position and releasing the hosiery item; and driving said lower belt for transfering said hosiery item together with said folding card onto said pivoting belt.

2. The method of claim 1, wherein said inclined surface is formed by an inclined belt.

3. The method of claim 1, wherein said inclined belt is driven at a higher speed than said lower belt when said hosiery item is moved together with said folding card from said inclined belt and said lower belt onto said pivoting belt which is in its downward position.

4. The method of claim 1, wherein said inclined belt is switched on before said lower belt is switched on, when said hosiery item is moved together with said folding card from said inclined belt and said lower belt onto said pivoting belt which is in its downward position.

5. A method for folding a hosiery item tightly about a folding card, said method comprising:

providing the hosiery item with a leading portion and a trailing portion;

folding said leading portion about said folding card backwardly against a direction of movement such that said folding card is enclosed between a lower layer and an upper layer of said leading portion;

supporting said leading portion with said folding card on a pivoting belt in a downward position thereof;

supporting said trailing portion on a lower belt behind said pivoting belt;

pivoting said pivoting belt upwardly and backwardly against the direction of movement, thereby folding the leading portion of the hosiery item together with the folding card against an inclined surface arranged at an acute angle relative to said lower belt;

clamping the hosiery item in the vicinity of said folding card between said leading and said trailing portions against said lower belt;

stretching the hosiery item on said folding card;

moving said pivoting belt back into its downward position and releasing the hosiery item;

driving said lower belt for transfering said hosiery item together with said folding card onto said pivoting belt;

moving at least one of two subsequent belts arranged upstream of said pivoting belt laterally away from the other one of said subsequent belts, to enlarge the space between the two subsequent belts;

transporting the hosiery item together with said folding card into the enlarged space between said two belts;

moving the two subsequent belts against each other again to press said hosiery item with said folding card therebetween.

6. The method of claim 5, wherein said two subsequent belts are moved against each other at an adjustable pressing force.

7. A device for folding a hosiery item tightly about a folding card, said device comprising:

a pivoting belt pivotable between a horizontal position and an inclined position;

a lower belt arranged downstream of said pivoting belt with respect to a direction of movement of said hosiery item;

an inclined surface arranged above said lower belt at an acute angle thereto;

means for providing the hosiery item with a leading portion and a trailing portion;

means for folding a leading portion of said hosiery item about said folding card backwardly such that said folding card is enclosed between a lower layer and an upper layer of said leading portion;

a clamping device arranged above said lower belt and below said inclined surface and being movable downwardly against said lower belt for clamping the hosiery item in the vicinity of said folding card between said leading and said trailing portions against said lower belt; and a tensioning device arranged between said claming device and said inclined surface for tensioning a hosiery item about said folding card when clamped by said claming device against said lower belt.

8. The device of claim 7, wherein said clamping means is a clamping slide.

9. The device of claim 8, wherein said clamping slide is provided with a forward edge that is bent off in downward direction.

10. The device of claim 7, wherein said tensioning means is a tensioning slide that can be moved into the space between said clamping slide and said inclined surface, and by means of which the hosiery item can be tensioned in the area of the lower end of said folding card.

11. The device of claim 7, wherein said inclined surface is formed by an inclined belt.

12. A device for folding a hosiery item tightly about a folding card, said device comprising:

a pivoting belt pivotable between a horizontal position and an inclined position;

a lower belt arranged downstream of said pivoting belt with respect to a direction of movement of said hosiery item;

an inclined surface arranged above said lower belt at an acute angle thereto;

means for providing the hosiery item with a leading portion and a trailing portion;

means for folding a leading portion of said hosiery item about said folding card backwardly such that said folding card is enclosed between a lower layer and an upper layer of said leading portion;

a clamping device arranged above said lower belt and below said inclined surface and being movable downwardly against said lower belt for clamping the hosiery item in the vicinity of said folding card between said leading and said trailing portions against said lower belt;

a tensioning device arranged between said claming device and said inclined surface for tensioning a hosiery item about said folding card when clamped by said claming device against said lower belt;

two subsequent belts arranged upstream of said pivoting belt, one of said subsequent belts being arranged above the other one of said subsequent belts in parallel thereto;

wherein at least one of said subsequent belts is arranged displaceably with respect to the other one between an open position and a closed position to allow unobstructed transport of said hosiery item with said folding card from said pivoting belt onto the other one of said subsequent belts, when being in its open position, and to allow pressing of said hosiery item with said folding card when being in its closed position.

* * * * *